US006513680B2

(12) United States Patent
Nakayoshi et al.

(10) Patent No.: US 6,513,680 B2
(45) Date of Patent: Feb. 4, 2003

(54) PASTE DISPENSING CONTAINER

(75) Inventors: Kazumi Nakayoshi, Chiba Prefecture (JP); Hiroki Ishikawa, Chiba Prefecture (JP); Ryoto Shima, Chiba Prefecture (JP); Junji Nakanishi, Chiba Prefecture (JP); Tomoko Kato, Chiba Prefecture (JP); Minoru Isshiki, Chiba Prefecture (JP); Kimio Yamakawa, Chiba Prefecture (JP)

(73) Assignee: Dow Corning Toray Silicone Co., LTD., Tokyo (JP)

( * ) Notice: Subject to any disclaimer, the term of this patent is extended or adjusted under 35 U.S.C. 154(b) by 0 days.

(21) Appl. No.: 09/841,895

(22) Filed: Apr. 25, 2001

(65) Prior Publication Data

US 2002/0008123 A1 Jan. 24, 2002

(30) Foreign Application Priority Data

Jul. 21, 2000 (JP) ..... 2000-220024

(51) Int. Cl.[7] ..... G01F 11/00
(52) U.S. Cl. ..... 222/1; 222/389
(58) Field of Search ..... 222/386, 389, 222/387

(56) References Cited

U.S. PATENT DOCUMENTS

| | | | | |
|---|---|---|---|---|
| 2,656,953 A | * | 10/1953 | Rich | 222/386 |
| 3,827,607 A | * | 8/1974 | Schultz | 222/389 |
| 5,139,178 A | * | 8/1992 | Arch et al. | 222/326 |
| 5,143,255 A | * | 9/1992 | Micek | 222/1 |
| 6,308,868 B1 | * | 10/2001 | Hoffman et al. | 222/153.01 |

FOREIGN PATENT DOCUMENTS

FR 2701927 A1 * 9/1994 ..... B65D/83/76

* cited by examiner

*Primary Examiner*—Lesley D. Morris
*Assistant Examiner*—Stephanie Willatt
(74) *Attorney, Agent, or Firm*—Larry A. Milco; Catherine U. Brown

(57) ABSTRACT

A paste dispensing container comprising a cylindrical container having positioned therein a piston slidable along the walls of the container, a first end closed with a cap to seal paste within the container, a connecting portion at a second end of the container for connection with a pressurized fluid supply, and a leakage preventing cover having an air orifice covering the second end of the container. The paste dispensing container can be vacuum packaged in a gas-impermeable film for shipping and storage to prevent exposure of the paste contained therein to air.

6 Claims, 2 Drawing Sheets

PASTE DISPENSING CONTAINER

FIELD OF THE INVENTION

The present invention relates to a paste dispensing container, and more particularly to a paste dispensing container that inhibits air bubbles from forming within the paste and remaining therein after storage and to a paste dispensing container having reduced cylindrical container deformation during storage.

BACKGROUND OF THE INVENTION

There is known in the art a paste dispensing container design having a dispensing opening at a first end of a cylindrical container, a connecting portion at a second end thereof for connection with a pressurized fluid supply, and a piston slidable along the inside wall of the container, whereby an adhesive, potting compound, or coating compound of paste form may dispensed therefrom by connecting the container to a pressurized fluid supply to operate the piston.

For storage or transport, the dispensing opening of a paste dispensing container of this kind is closed with a cap to seal the paste within the container, a paste leakage preventing cover is attached to the end thereof having the connecting portion for connection with the pressurized fluid supply, and the container is then vacuum packaged in gas-impermeable film. However, air remaining in the gap between the paste leakage preventing cover and the piston located within the cylindrical container migrates into the paste during storage or transport, with the result that air bubbles form and remain in the paste even after the vacuum package has been opened and the product returned to normal pressure, resulting in failure of the paste to dispense continuously, or inability to dispense a measured amount. Further, since the cylindrical container is constructed of flexible plastic, where the cylindrical container has considerable lengthwise extension, irreversible deformation of the cylindrical container may occur during the process of vacuum packaging it in gas-impermeable film, in some instances making it impossible to install in the dispensing device.

It is an object of the present invention to provide a paste dispensing container that inhibits air bubbles from forming within the paste and remaining therein after storage, and to provide a paste dispensing container having reduced cylindrical container deformation during storage.

SUMMARY OF THE INVENTION

A paste dispensing container comprising a cylindrical container having positioned therein a piston slidable along the walls of the container, a first end closed with a cap to seal paste within the container, a connecting portion at a second end of the container for connection with a pressurized fluid supply, and a leakage preventing cover having an air orifice covering the second end of the container. The paste dispensing container can be vacuum packaged in a gas-impermeable film for shipping and storage to prevent exposure of the paste contained therein to air.

DESCRIPTION OF THE INVENTION

A paste dispensing container comprising a cylindrical container having positioned therein a piston slidable along the walls of the container, a first end closed with a cap to seal paste within the container, a connecting portion at a second end of the container for connection with a pressurized fluid supply, and a leakage preventing cover having an air orifice covering the second end of the container. The paste dispensing container can be vacuum packaged in a gas-impermeable film for shipping and storage to prevent exposure of the paste contained therein to air.

Figure 1:
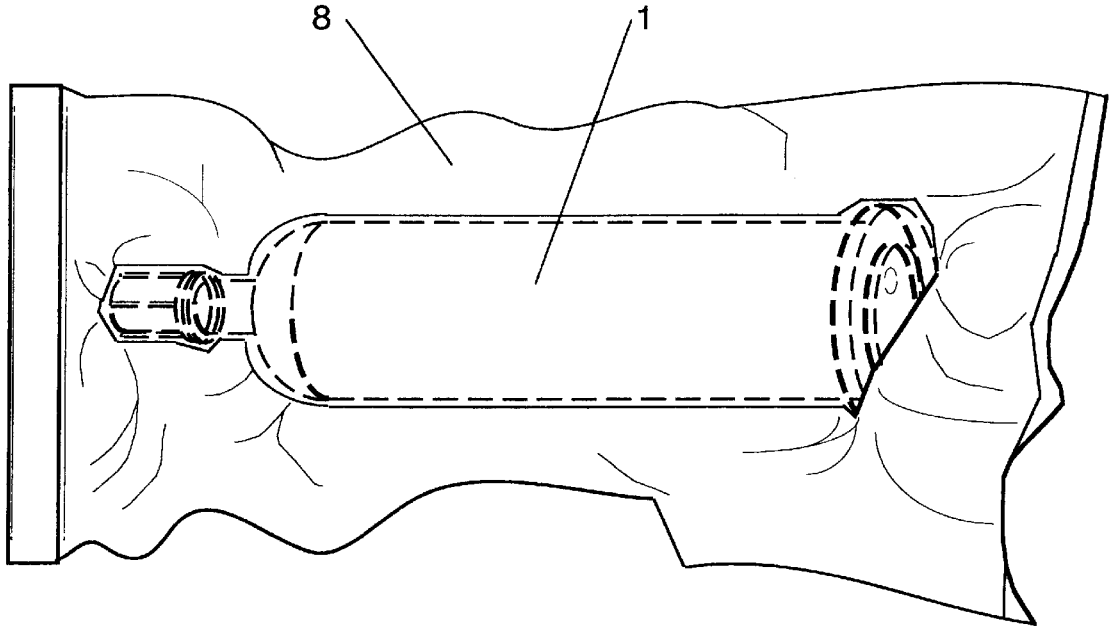
FIG. 1—Perspective view of the paste dispensing container of the invention.
Figure 2:
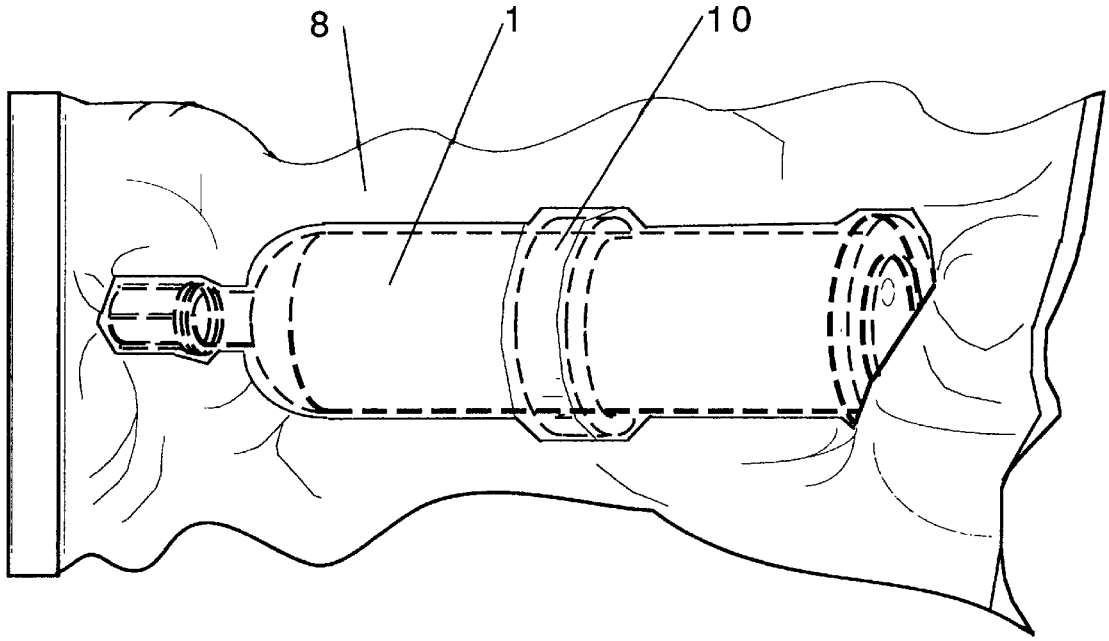
FIG. 2—Perspective view of the paste dispensing container of the invention.

A fuller understanding of the invention is provided through the following description made with reference to the accompanying drawings. The present paste dispensing container comprises a cylindrical container 1 in which is sealed a paste and which is vacuum packaged in a gas-impermeable film 8 as depicted in FIGS. 1 and 2, for example. The cylindrical container 1 depicted in FIG. 2 can be sheathed by a cylindrical or annular reinforcing material 10 before being vacuum packaged in gas-impermeable film 8.

Figure 3:
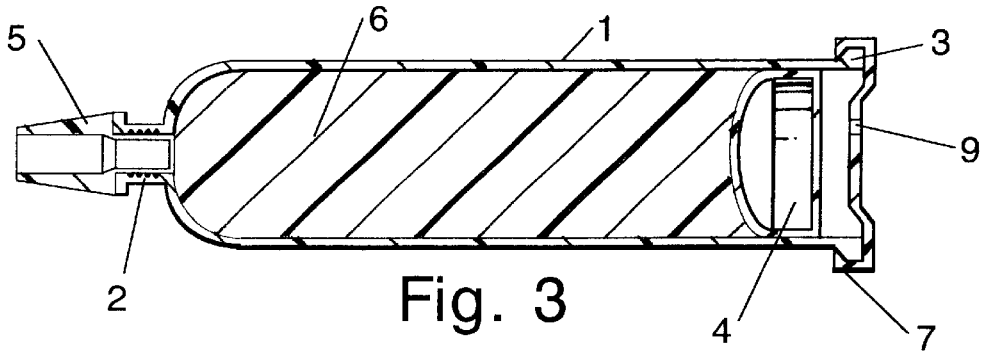
FIG. 3—Sectional view of the paste dispensing container prior to vacuum packaging.

The paste dispensing container prior to being vacuum packaged in gas-impermeable film is described with reference to FIG. 3. Cylindrical container 1 has a dispensing opening 2 at a first end thereof, and a connecting portion 3 at a second end thereof for connection with a pressurized fluid supply. Materials for cylindrical container 1 include plastics such as polyethylene resin and polypropylene resin and metals such as aluminum and stainless steel. In preferred practice, a plastic such as polyethylene resin or polypropylene resin will be used as the material for cylindrical container 1 so as to permit verification of the amount of paste remaining in the container. Dispensing opening 2 has a connecting structure permitting attachment of a nozzle or cap thereto, the connecting structure typically consists of a thread arrangement. In FIG. 3, dispensing opening 2 is provided closure by a threaded cap 5. Materials for cap 5 include plastics such as polyethylene resin and polypropylene resin and metals such as aluminum and stainless steel. In preferred practice, cap 5 will be fabricated of the same material as cylindrical container 1 in order to prevent paste leakage due to thermal expansion and contraction of the paste dispensing container. The cap 5 is removed when dispensing the paste. The connecting structure of the connecting portion for connection with the pressurized fluid supply may consist of a flange, thread arrangement, or the like. In FIG. 3, the connecting portion for connection with the pressurized fluid supply consists of a flange.

Cylindrical container 1 houses a piston 4 that slides along the inside wall of the container. The piston 4 is designed to be pushed by a pressurized fluid (typically air) delivered by a pressurized fluid supply, thereby dispensing the paste. Configurations for piston 4 include a circular cylinder whose outside wall extends parallel to the inside wall of cylindrical container 1 with a circular cylinder open at the pressurized fluid supply connecting portion end, a circular cylinder whose dispensing opening end is conical in shape, an hourglass or bobbin shape whose outside wall at the distal end and/or basal end thereof contacts the inside wall of the cylindrical container, an hourglass shape whose dispensing opening end is conical in shape, or a bobbin shape whose dispensing opening end is conical in shape. Materials for piston 4 include plastics such as polyethylene resin and polypropylene resin and metals such as aluminum and stainless steel. In preferred practice, piston 4 will be fabricated of the same material as cylindrical container 1 in order to minimize paste leakage due to thermal expansion and contraction of the paste dispensing container.

The space between dispensing opening 2 and piston 4 within cylindrical container 1 is filled with a paste 6. Examples of paste 6 are curing types and non-curing types. Curing type pastes include silicone rubber materials, silicone resin materials, urethane resin materials, epoxy resin materials, polyimide resin materials, and the like. Non-curing type pastes include greases and pastes. Suitable pastes 6 will have a viscosity at 25° C. of no more than 1,000 Pa s and preferably no more than 100 Pa s.

Figure 4:
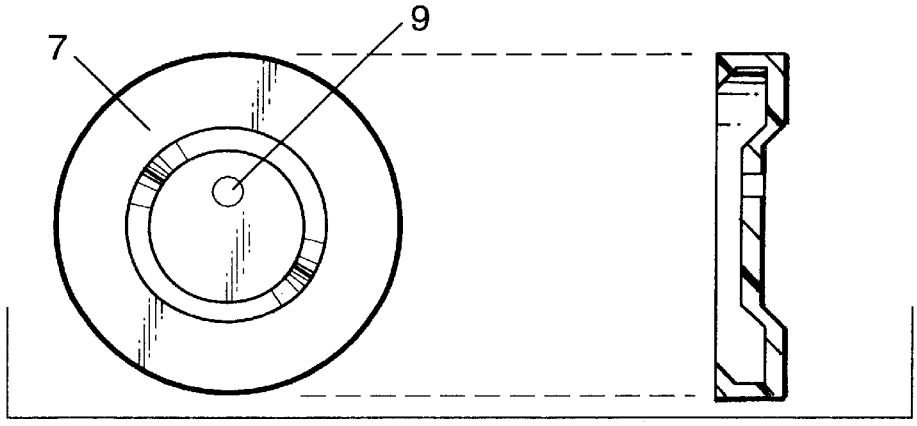
FIG. 4—Front view and sectional view of the cover.

Since there exists a risk that paste leaking through the gap between piston 4 and the inside wall of cylindrical container 1 may soil the outside wall of cylindrical container 1, the end of cylindrical container 1 at which is located the connecting portion 3 for connection with a pressurized fluid supply is provided with a cover 7 for preventing leakage of paste 6. Materials for cover 7 include plastics such as polyethylene resin and polypropylene resin and metals such as aluminum and stainless steel. In preferred practice, cover 7 will be fabricated of the same material as cylindrical container 1 in order to prevent paste leakage due to thermal expansion and contraction of the paste dispensing container. In FIG. 3, cover 7 fits onto a flange at the end of the container, but this configuration is not limiting, it being possible to use a connecting structure such as a thread arrangement or the like. The cover 7 is removed when dispensing the paste. In the paste dispensing container herein, cover 7 is provided with an air orifice 9 passing through the cover 7 at its center or central portion, as shown in FIG. 4. In FIG. 4, cover 7 is provided with a single air orifice 9, but two or more air orifices 9 could be provided if needed.

Figure 5:
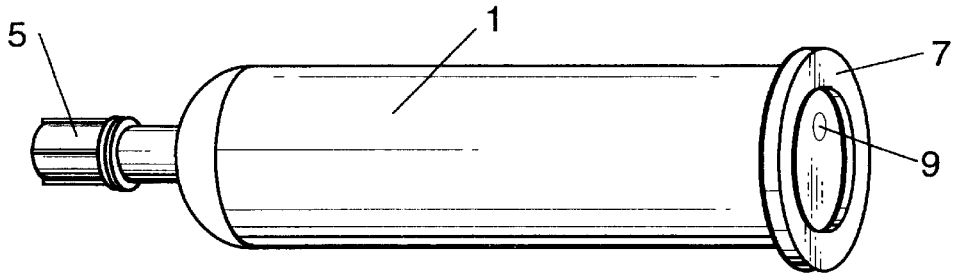
FIG. 5—Perspective view of the paste dispensing container prior to vacuum packaging.
Figure 6:
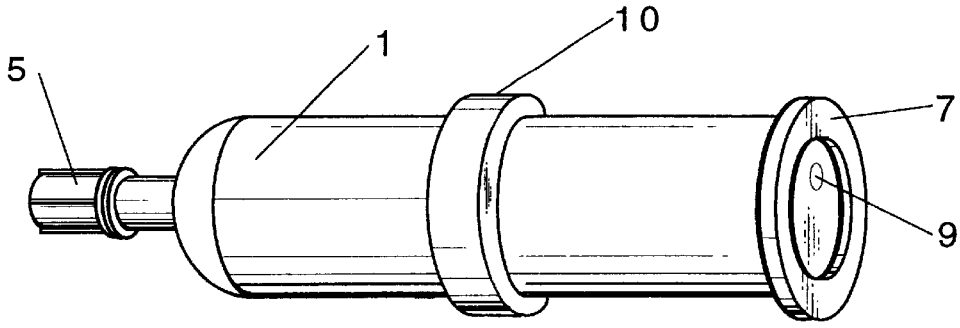
FIG. 6—Perspective view of the paste dispensing container prior to vacuum packaging.

Paste dispensing containers having paste 6 sealed therein and provided with a cover 7 are shown in FIGS. 5 and 6. In FIG. 6, cylindrical container 1 is sheathed on its outer surface by a cylindrical or annular reinforcing material 10. This cylindrical or annular reinforcing material 10 is intended to prevent deformation of the cylindrical container during vacuum packaging, and while not required in cases where the cylindrical container resists deformation, is required in cases where the cylindrical container deforms easily. Accordingly, the cylindrical or annular reinforcing material 10 is fabricated from a material having little flexibility, examples of such materials being plastics such as epoxy resins, acrylic resins, polycarbonate resins, and vinyl chloride resins; paper; paper/plastic composite materials; fabric/plastic composite materials; and metals such as aluminum and stainless steel. Specific examples of cylindrical or annular reinforcing material 10 are acrylic resin pipe, acrylic resin ring, polycarbonate resin pipe, polycarbonate resin ring, metal pipe, or metal ring. As the cylindrical or annular reinforcing material 10 is removed when dispensing the paste, it should fit loosely enough around the outer surface of the cylindrical container 1 to permit easy removal thereof.

The paste dispensing container herein may be produced by placing cylindrical container 1 within gas-impermeable film 8, evacuating the film interior to remove air, and then thermocompression bonding the film edges. Examples of gas-impermeable film 8 are a plastic film of polyethylene or polyvinylidene chloride, a composite sheeting of a polyolefin such as polyethylene, polypropylene, and ethylene/vinyl acetate copolymer, or a polyolefin derivative laminated with aluminum foil.

For use, the present paste dispensing container is taken from the vacuum package to return the paste dispensing container to normal pressure. Caps 5 and 7 are removed and cylindrical container 1 is installed in a pressurized fluid delivery unit and connected to a pressurized fluid supply. The paste 6 may then be dispensed by pushing piston 4 with the pressurized fluid. The paste dispensing container herein is therefore suitable as a dispensing container for die bonding compounds, potting compounds, or junction coating compounds that require storage at low temperature.

EXAMPLES

A fuller understanding of the paste dispensing container herein is provided through the following examples.

Comparative Example 1

Using a 2.5-ounce cartridge (capacity 74 mL; dimensions: 42.9 mm outside diameter, 99 mm length; material: polyethylene resin), from EFD Inc. (USA), as the cylindrical container; the dispensing opening thereof was sealed with a multiseal outlet cap (material: polyethylene resin) also from EFD. The cylindrical container was then gently filled with about 70 mL of a silicone potting compound (25° C. viscosity: 10 Pa·s), taking care to avoid introducing entrained air. A skirted plunger (material: polyethylene resin), also from EFD, was then inserted therein as a piston and the assembly was capped with an end cap (material: polyethylene resin), also from EFD.

The cylindrical container was placed in a pouch (size: 120 mm×250 mm) constructed of a thermocompression bondable triple-layer laminate of nylon (thickness 0.02 mm)/polyethylene (thickness 0.02 mm)/polyethylene (thickness 0.04 mm) coated on its surface with polyvinylidene chloride. The pouch was then evacuated to 5 torr to remove air while thermocompression bonding the bag opening, to produce a paste dispensing container.

The paste dispensing container was stored for 5 months in a freezer maintained at −20° C.±5° C. The vacuum package was then opened at room temperature and allowed to return to normal pressure. When the cylindrical container was inspected one day later, air bubbles were noted to remain in the potting compound. When the paste dispensing container was installed in an air pressure unit and it was attempted to dispense the potting compound, the potting compound frequently and repeatedly failed to dispense continuously.

Example 1

A paste dispensing container was produced in the same manner as in Comparative Example 1, except for boring a 5 mm-diameter air orifice through the center of the end cap (material: polyethylene resin), from EFD Inc. (USA), and was stored for 5 months in a freezer maintained at −20° C.±5° C. The vacuum package was then opened at room temperature and allowed to return to normal pressure. When the cylindrical container was inspected one day later, no air bubbles were noted to remain in the potting compound. When the paste dispensing container was installed in an air pressure unit and it was attempted to dispense the potting compound, the potting compound dispensed in a constant uninterrupted stream.

Example 2

Using a 6-ounce cartridge (capacity 180 mL; dimensions: 42.9 mm outside diameter, 179 mm length; material: polyethylene resin), from EFD Inc. (USA), as the cylindrical container, the dispensing opening thereof was sealed with a multiseal outlet cap (material: polyethylene resin) also from EFD. The cylindrical container was then gently filled with about 150 mL of a silicone potting compound (25° C. viscosity: 10 Pa·s), taking care to avoid introducing entrained air. A skirted plunger (material: polyethylene resin), also from EFD, was then inserted therein as a piston, and the assembly was capped with an EFD end cap (material: polyethylene resin) having a 5 mm-diameter air orifice bored through the center thereof.

The cylindrical container was placed in a pouch (size: 120 mm×250 mm) constructed of a thermocompression bondable triple-layer laminate of nylon (thickness 0.02 mm)/polyethylene (thickness 0.02 mm)/polyethylene (thickness 0.04 mm) coated on its surface with polyvinylidene chloride. The pouch was then evacuated to 5 torr to remove air while thermocompression bonding the bag opening to produce a paste dispensing container.

The paste dispensing container was then stored for 5 months in a freezer maintained at −20° C.±5° C. When the outside of the frozen paste dispensing container was examined, the central portion of the cylindrical container was observed to have undergone appreciable deformation. The vacuum package was then opened at room temperature and allowed to return to normal pressure. When the outside of the cylindrical container was inspected one day later, the deformed cylindrical container had not returned to its original shape. No air bubbles were observed in the potting compound. When the paste dispensing container was installed in an air pressure unit and it was attempted to dispense the potting compound, the potting compound dispensed in a constant uninterrupted stream.

Example 3

A paste dispensing container was produced in the same manner as in Example 2 except for sheathing the central portion of the cylindrical container with a transparent acrylic resin pipe (inside diameter 44 mm, outside diameter 50 mm, length 20 mm) before vacuum packing the container in a pouch constructed of a three-layer laminate film.

The paste dispensing container was then stored for 5 months in a freezer maintained at −20° C.±5° C. When the outside of the frozen paste dispensing container was examined, no deformation of the cylindrical container was observed. The vacuum package was then opened at room temperature and allowed to return to normal pressure. When the outside of the cylindrical container was inspected one day later, no air bubbles were observed in the potting compound. When the paste dispensing container was installed in an air pressure unit and it was attempted to dispense the potting compound, the potting compound dispensed in a constant uninterrupted stream.

What is claimed is:

1. A method comprising:

(1) filling a cylindrical container, having a first end closed with a cap, with a paste;

(2) inserting a piston slidable along the walls of the cylindrical container in the cylindrical container, where the cylindrical container has a connecting portion at a second end of the cylindrical container for connection with a pressurized fluid supply;

(3) capping the second end of the cylindrical container with a removable end cap having an air orifice, and (4) vacuum packaging the product of step (3) in a gas impermeable film.

2. The method of claim 1, further comprising:

(5) removing the product of step (4) from the gas impermeable film, (6) removing the removable end cap, and (7) connecting the pressurized fluid supply to the connecting portion of the cylindrical container.

3. The method of claim 2, further comprising:

(8) removing the end cap and dispensing the paste.

4. The method of claim 3, where the cylindrical container is sheathed by a cylindrical or annular reinforcing material prior to step (4).

5. The method of claim 4, where the cylindrical or annular reinforcing material is removed prior to step (8).

6. The method of claim 1, where the cylindrical container is sheathed by a cylindrical or annular reinforcing material prior to step (4).

* * * * *